US009976795B2

(12) United States Patent
Becke et al.

(10) Patent No.: US 9,976,795 B2
(45) Date of Patent: May 22, 2018

(54) REFRIGERATOR

(71) Applicant: BSH HAUSGERAETE GMBH, Munich (DE)

(72) Inventors: Christoph Becke, Grosskarolinenfeld (DE); Max Eicher, Munich (DE); Klaus Foersterling, Amerang (DE); Christine Hartwein, Nandlstadt (DE); Andreas Kessler, Munich (DE); Philipp Kleinlein, Munich (DE); Ralph Staud, Munich (DE); Thomas Tischer, Haar (DE)

(73) Assignee: BSH Hausgeraete GmbH, Munich (DE)

( * ) Notice: Subject to any disclaimer, the term of this patent is extended or adjusted under 35 U.S.C. 154(b) by 0 days. days.

(21) Appl. No.: 15/327,092

(22) PCT Filed: Jul. 17, 2015

(86) PCT No.: PCT/IB2015/055422

§ 371 (c)(1),
(2) Date: Jan. 18, 2017

(87) PCT Pub. No.: WO2016/009395

PCT Pub. Date: Jan. 21, 2016

(65) Prior Publication Data

US 2017/0191737 A1 Jul. 6, 2017

(30) Foreign Application Priority Data

Jul. 18, 2014 (CN) ..... 2014 1 0346458

(51) Int. Cl.

| | |
|---|---|
| ***A47B 96/04*** | (2006.01) |
| ***F25D 23/02*** | (2006.01) |
| ***F25D 11/00*** | (2006.01) |

(52) U.S. Cl.
CPC ..... *F25D 23/028* (2013.01); *F25D 11/00* (2013.01); *F25D 2323/021* (2013.01); *F25D 2400/361* (2013.01)

(58) Field of Classification Search
CPC .. F25D 23/028; F25D 11/00; F25D 2323/021; F25D 2400/361

(Continued)

(56) References Cited

U.S. PATENT DOCUMENTS

| | | | | |
|---|---|---|---|---|
| 8,398,186 B2 * | 3/2013 | Higami | ..... | F25D 23/025 312/405 |
| 8,485,617 B2 * | 7/2013 | Park | ..... | F25D 23/028 312/405.1 |

(Continued)

FOREIGN PATENT DOCUMENTS

| | | |
|---|---|---|
| CN | 2699206 Y | 5/2005 |
| DE | 102012200812 A1 | 7/2013 |

(Continued)

*Primary Examiner* — Daniel J Troy
*Assistant Examiner* — Timothy M Ayres
(74) *Attorney, Agent, or Firm* — Laurence A. Greenberg; Werner H. Stemer; Ralph E. Locher

(57) ABSTRACT

A refrigerator includes a door having a user-interface electrical module, a door liner, a front wall being located in front of the door liner and having a first opening, a side wall, and a thermal insulation space being located between the door liner and the front wall and being filled with a heat insulation layer. The side wall has a second opening in communication with the first opening. The door includes a user-interface housing which closes the first opening and the second opening relative to the thermal insulation space and includes a receiving space for receiving the user-interface electrical module and a concave portion being open towards the first opening and the second opening to permit access to a handle groove within the user-interface housing.

14 Claims, 9 Drawing Sheets

(58) Field of Classification Search
USPC ..... 312/405
See application file for complete search history.

(56) References Cited

U.S. PATENT DOCUMENTS

| | | | | |
|---|---|---|---|---|
| 2011/0273071 | A1* | 11/2011 | Kim | F25D 23/028 312/405 |
| 2013/0099650 | A1* | 4/2013 | Lee | F25D 23/028 312/404 |
| 2016/0138853 | A1* | 5/2016 | Kim | F25D 23/028 312/405 |

FOREIGN PATENT DOCUMENTS

| | | | |
|---|---|---|---|
| JP | 2004044980 | A | 2/2004 |
| JP | 2013178054 | A | 9/2013 |

* cited by examiner

REFRIGERATOR

BACKGROUND

Technical Field

The present invention relates to a refrigerator, and in particular, to a household refrigerator that has a door.

Related Art

CN 2699206 Y discloses a refrigerator door. The refrigerator door includes a front wall, an inner door plate and a door cover. The front wall, the inner door plate and the door cover are combined together by using a foaming heat insulation layer that is filled between the front wall and the inner door plate. The front wall has an edge opening and the edge opening is sealed by the door cover. The door cover has a concave portion that is dent towards the heat insulation layer A detachable decorative plate is installed on the door. A rear side of the decorative plate has an accommodation space. The decorative plate and control and display components are pre-assembled to form a pre-assembled unit. The pre-assembled unit is fixed on the door after a foaming process of the door.

JP 2013-178054 A discloses a refrigerator door, including a door main body that has a heat insulation layer. A user interface apparatus is disposed in a middle area of the door main body viewed from a vertical direction, and located behind a glass plate of the door main body. A side cover at a right end portion of the door main body is formed with a step component that enables a front surface to be concave. The step component accommodates an accommodating room of the user interface apparatus in a sealed manner. A handle member that protrudes rightwards is installed, by using a screw, on an installation surface of a side surface that faces to the step component. A handle groove that extends at a whole height of the door is formed between the handle member and the step component. A front surface of the handle portion is covered by a protection cover that is clamped between a front end of the handle portion and the step component. The protection cover is formed by transparent resin.

SUMMARY

An objective of the present invention is to solve at least one technical problem in the prior art, and to provide an improved refrigerator.

The foregoing objective may be implemented by using features in the independent claims. Preferred embodiments of the present invention are subjects of accompanying drawings, the specification, and dependent claims.

One aspect of the present invention relates to a refrigerator. The refrigerator includes a door; the door includes a user-interface electrical module, a door liner, a front wall that is located in front of the door liner and has a first opening, a side wall, and a thermal insulation space that is located between the door liner and the front wall and filled with a heat insulation layer, where the side wall has a second opening that is in communication with the first opening; the door includes a user-interface housing which closes the first opening and the second opening relative to the thermal insulation space, and includes a receiving space for receiving the user-interface electrical module, and a concave portion open towards the first opening and the second opening to give access to a handle groove within the user-interface housing.

In this way, an operation center that includes a user interface and handle related elements may be integrated inside one user-interface housing, and the handle related elements and a user electrical interface of the refrigerator may be integrated together, so that operation functions of the refrigerator may be visually integrated in one area of the door. In addition, the user-interface housing is constructed independently of the side wall and fixedly attached to the heat insulation layer after a foaming process, and the concave portion may give access to, by using the first opening, the second opening that is in communication with the first opening. Therefore, the side wall may have a simpler construction without being provided with a step portion in the prior art so as to serve operation functions, and even such possibility is provided that: the side wall and the front wall may be of a one-piece structure, for example, formed by a single metal sheet; or even though the handle groove does not extend at a whole height/width of the door, the side wall may be formed in a manner of extrusion.

Further, when a same user-interface housing is used to undertake a handle function and a function of a user electrical surface, a quantity of components and parts of a pre-assembled unit involved in a foaming process may be reduced, so that it is easier to prevent a foaming agent from leaking between the user-interface housing with the front wall and/or the side wall.

It should be understood that the present invention may be applicable to refrigerators with various structures, and should not be limited to the preferred embodiments disclosed in the present invention. For example, the present invention may be applicable to a side-by-side combination refrigerator that has a first storage compartment and a second storage compartment that are arranged side by side, or may be applicable to a refrigerator that has a first storage compartment and a second storage compartment that are arranged from top to bottom, or may also be applied to a refrigerator that has a pair of doors that close a same storage compartment.

A storage compartment of the refrigerator may be used to store food and/or wine, for example, the refrigerator may have at least one storage compartment that is exclusively used to store wine.

The door may be pivotally connected to a rotary door of a main body of the refrigerator, or may also be connected in a push-and-pull manner to a drawer-type door of the main body.

The door may close one or more storage compartments of the refrigerator, or may also close a part of one or more storage compartments.

In a possible embodiment, the concave portion may be disposed in adjacent to a vertical side of the door. In an alternative embodiment, the concave portion is disposed in adjacent to a horizontal side portion of the door, for example, disposed at a top portion or a bottom portion.

The user-interface electrical module may include an input unit that is used to receive an input instruction of a user, and/or an output unit that is used to display information to a user. The user-interface electrical module may be located totally inside the receiving space, or may also be partly located in the receiving space and partly located outside the receiving space.

The user-interface electrical module may include a touch unit to receive a touch instruction of a user. In an alternative embodiment, the user-interface electrical module may also receive an instruction from a user by using another input apparatus such as a key button.

The front wall and the side wall may be manufactured independently and then assembled together. In an alternative embodiment, the front wall and the side wall may also be formed by different parts of a single component.

The front wall is located in front of the door liner. In a possible embodiment, the front wall forms at least the vast majority of a front surface of the door, that is, the front door is exposed outside. In another possible embodiment, the door may also include a decorative plate that is located in front of the front wall. Such decorative plate may be made of glass or a glass-like material.

In a possible embodiment, the front wall is formed by a single component, for example, the front wall may be formed by a metal sheet. In another possible embodiment, the front wall may also be formed by multiple components, and these components may form corresponding parts of the front wall wholly or partially. In the latter case, the first opening is formed together by openings formed in different components.

In a possible embodiment, the side wall is a vertical side wall of the door, such as, a left wall or a right wall. In another possible embodiment, the side wall may also be a horizontal side wall of the door, such as, a top wall or a bottom wall.

Another single feature or another combination of features that is considered as a feature of a property of the present invention is described in the following appended claims.

In a possible embodiment, a length of the concave portion is equal to or slightly less than a length of the first opening and/or the second opening. The length in this respect is measured in direction along the length direction of the side wall, that is typically vertically. In this way, two ends of the concave portion may be very close to corresponding edges of the first opening and/or the second opening, which makes it possible that corresponding boundaries of the first opening and the second opening are used to indicate end portions of the concave portion and the handle groove. More importantly, the concave portion and the handle groove accessible through the concave portion may extend along a whole length of the first opening and/or the second opening, or have a length that is slightly less than but very closely equal to the length of the first opening and/or the second opening. In this way, the handle groove and the concave portion may have a largest length inside the first opening and the second opening. The first opening and the second opening may be designed according to requirements of lengths of the handle groove and the concave portion.

In a possible embodiment, the first opening includes a pair of opposite edges, and the edges are parallel to a top surface of the door, which especially helps the user-interface housing and the front wall to be connected along the first opening.

In a possible embodiment, the first opening and the second opening are located at a same height of the door, and have a same length in a length direction of the side wall.

In a possible embodiment, the concave portion, the handle groove and the user-interface electrical module are sequentially arranged side by side in a depth direction of the handle groove. Because the concave portion, the handle groove and the user-interface electrical module are sequentially arranged side by side in a depth direction of the handle groove, and do not overlap in a length direction of the handle groove, each of the concave portion, the handle groove and the user-interface electrical module can obtain a larger length in a boundary frame when needed. In this way, when the door may have a compact operation center, the concave portion and the handle groove may have a length large enough to enable a user to conveniently put a hand in the handle groove to grab the grip portion so as to open the door. Similarly, the user electrical interface of the user operation center may also occupy a larger size on the door.

When the concave portion and the handle groove are disposed in adjacent to a vertical side of the door, for example, in adjacent to a left side or a right side of the door, the depth direction of the handle groove is a horizontal direction of the door, when the concave portion and the handle groove are disposed in adjacent to a horizontal side of the door, for example, at a top portion or a bottom portion of the door, the depth direction of the handle groove is a length direction of the door (which may also be referred to as a height direction).

In a possible embodiment, the user-interface housing includes a first rear wall that is fixed to the heat insulation layer, and the first rear wall defines a rear boundary of the handle groove and the concave portion. In this way, the concave portion and the handle groove may have a continuous rear boundary. In addition, the rear boundary of the concave portion and the handle groove is directly formed by the user-interface housing, which helps to increase sizes of the concave portion and the handle groove in a direction of a door width.

In a possible embodiment, the receiving space has an inlet open towards the handle groove, the user-interface electrical module is accessible through the inlet, and the inlet is closed by a handle member that is detachably connected to the user-interface housing. In this way, even though the first opening is covered by an extra component, the user-interface electrical module may also be disposed in the receiving space or taken out from the receiving space through the inlet open towards the second opening, which also enables forms for disposing other components in front of the front wall to be diversified.

In a possible embodiment, the door includes a one-piece front panel, the front panel covers, in a front-to-rear direction, the user-interface electrical module and a grip portion that is located in front of the handle groove. This especially helps to enable the handle function and the user electrical interface to form a neat and integrated visual unit. Meanwhile, this also prevents the user from pulling a rear side of the front panel when opening the door. In this way, possibility that the front panel drops from the door is significantly reduced.

In a possible embodiment, the grip portion is an integral part of the user-interface housing. Because the grip portion is directly formed on the user-interface housing, the grip portion does not need to be additionally manufactured separately and installed on the door.

In a possible embodiment, the front panel covers the front wall, and is provided on one edge with an edge opening that corresponds to the concave portion. In this way, the front surface of the door may be formed by the front panel, which makes it possible that the door has a continuous front surface.

In a possible embodiment, the front panel is detachably fixed to the user-interface housing along the first opening.

In a possible embodiment, the front wall has a first flange bent backwards from an edge of the first opening, the user-interface housing includes a first insertion groove in adjacent to a corresponding end of the concave portion, the first flange includes a first part overlapping with the concave portion in a length direction of the concave portion, and a second part surrounding an edge of the front panel, where the first part is inserted into the first insertion groove, and the second part is located between the front panel and the user-interface housing. In this way, the user-interface housing and the front wall may be reliably positioned through coordination of the first insertion groove and the first flange, and meanwhile, at the part that surrounds the front panel, the first flange and the user-interface housing are not connected in a manner of inserting of an insertion groove, but in a manner of directly facing the first flange to the front panel. In this way, the user-interface housing does not appear between the front wall and the front panel, and a connection seam that opens forwards does not surround an area of the front panel, which especially helps the door to obtain a simple and clean front design, and helps to reduce duct that enters the connection seam that is between the front wall and user-interface housing and is difficult to clean.

In a possible embodiment, the user-interface housing includes a groove wall of the first insertion groove and close to the concave portion, and the front panel is in contact with an end surface of the groove wall which end surface is close to the front panel. In this way, the front panel may be reliably positioned.

In a possible embodiment, the front panel includes a front plate portion that covers the user-interface electrical module and the grip portion in a front-to-rear direction, and a side plate portion that is connected from one side of the front plate portion and extends backwards, and the side plate portion covers at least a part of the grip portion in a depth direction of the handle groove.

In a possible embodiment, the user-interface housing includes a first connection flange that is connected to a rear surface of the front wall, and a second connection flange that is connected to the side wall, and the first connection flange is at least approximately perpendicular to the second connection flange.

In a possible embodiment, the front wall has a first flange bent backwards from an edge of the first opening, the side wall has a second flange bent inwards from an edge of the second opening, the first flange being connected to the second flange, the user-interface housing comprises a first insertion groove and a second insertion groove in communication with the first insertion groove, the first flange being inserted in the first insertion groove, and the second flange being inserted in the second insertion groove. On one hand, this helps connection and position between the user-interface housing and the front wall and the side wall, on the other hand, any part of the user-interface housing may be not disposed at an outer side of the front wall and the side wall, it may be predictable that the door has a simple and clean appearance, and it is possible that a front side of a door main body obtained through a foaming process is almost flat, so as to connect an extra decorative front panel when needed.

The construction of the present invention and other inventive objectives and beneficial effects of the present invention are more understandable through description of the preferred embodiments with reference to the accompanying drawings.

BRIEF DESCRIPTION OF THE DRAWINGS

As a part of the specification and used for provide further understanding on the present invention, the following accompanying drawings illustrate specific implementation manners of the present invention, and are used to describe the principle of the present invention along with the specification. Wherein.

DETAILED DESCRIPTION

Figure 1:
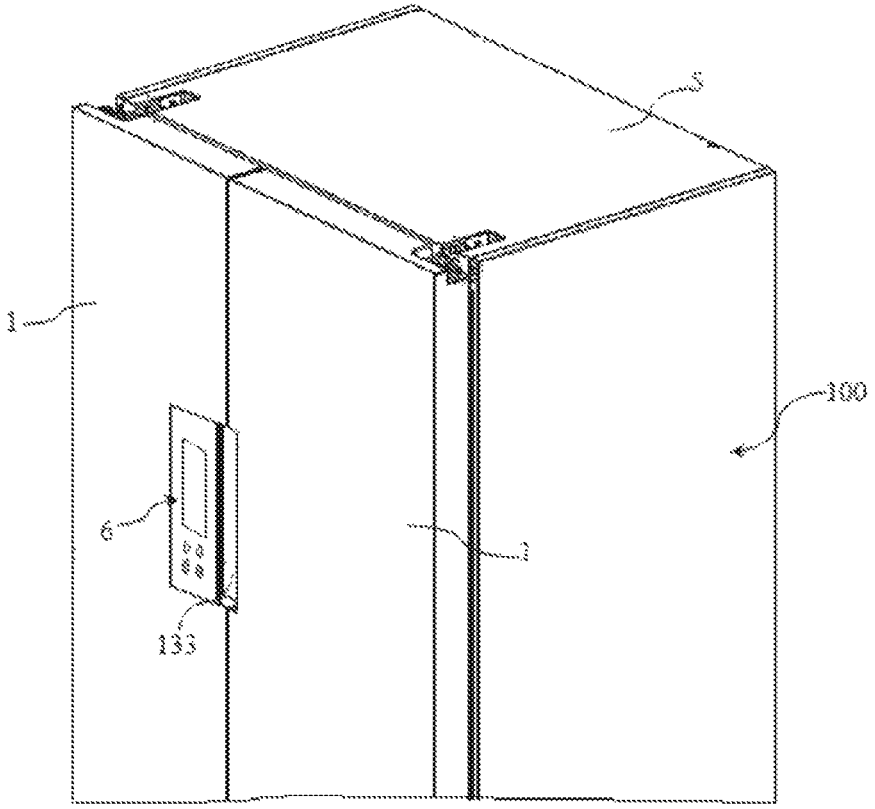
FIG. 1 is a schematic three-dimensional diagram of a part of a refrigerator according to a preferred embodiment of the present invention.

FIG. 1 is a schematic three-dimensional diagram of a refrigerator 100 according to a preferred embodiment of the present invention. As shown in FIG. 1, the refrigerator 100 includes a main body 5 that has a first storage compartment (which is not shown in the figure) and a second storage compartment (which is not shown in the figure) that are arranged side by side. The refrigerator 100 further includes a pair of side-by-side combination doors 1 and 1' that are connected to the main body 5 and used for separately closing corresponding storage compartments.

Figure 2:
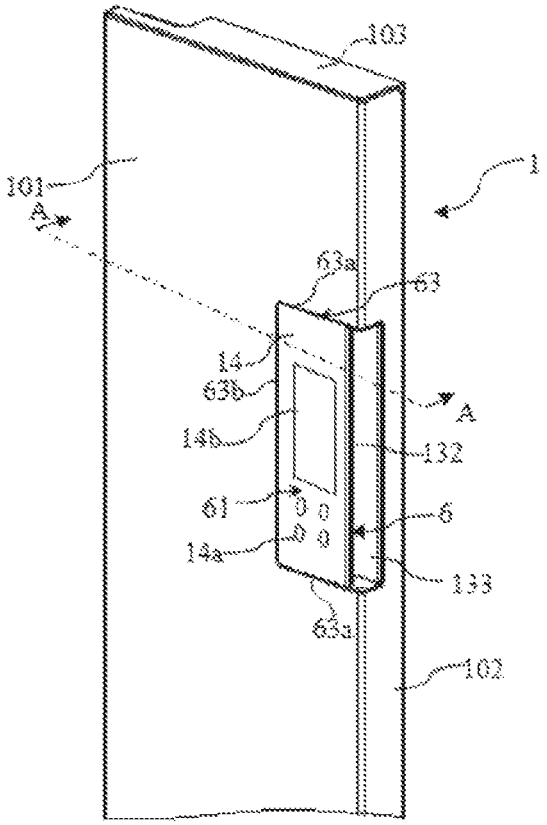
FIG. 2 is a schematic three-dimensional diagram of a part of a door according to a preferred embodiment of the present invention.
Figure 3:
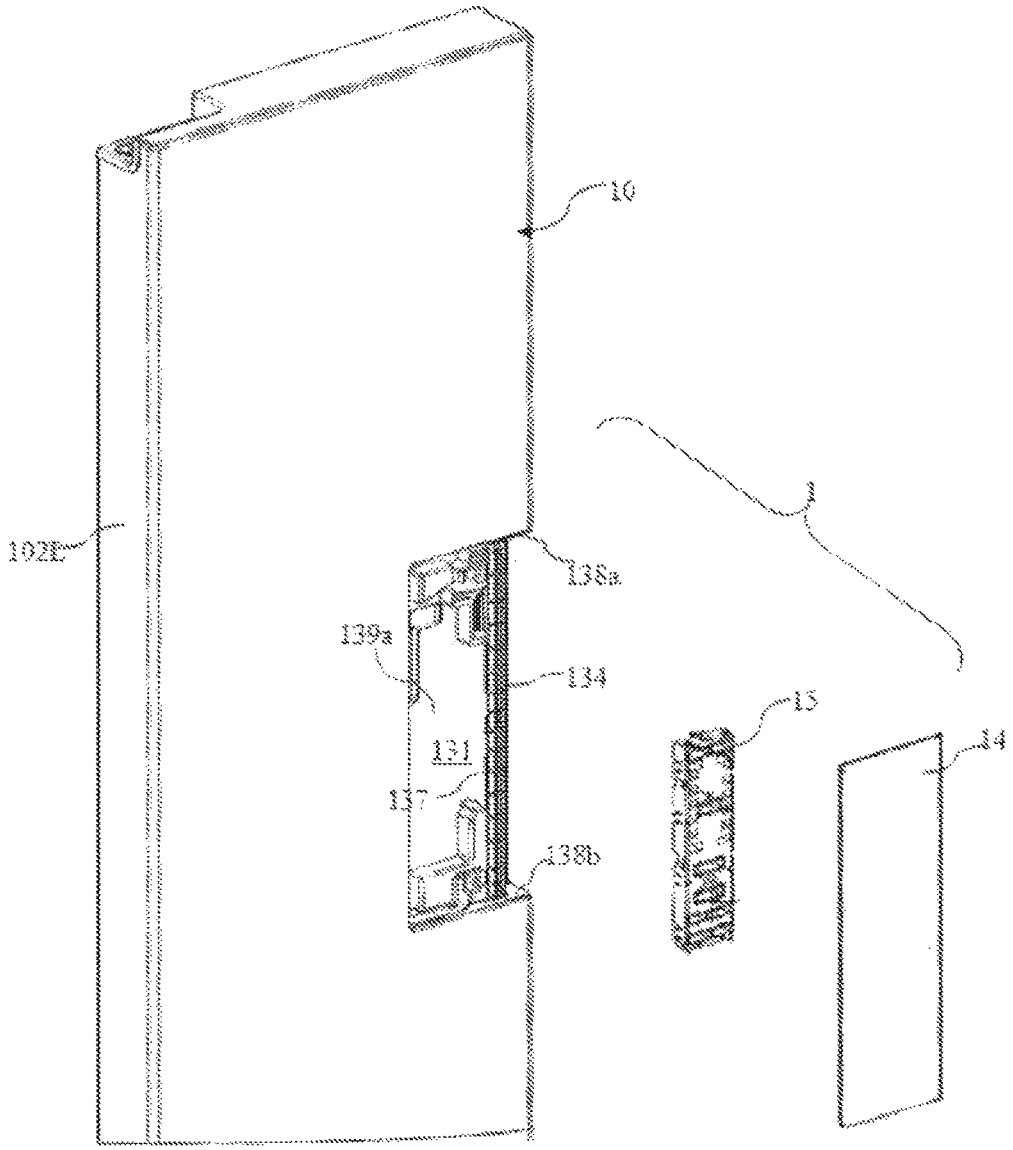
FIG. 3 is a schematic exploded view of a part of a door according to a preferred embodiment of the present invention.

With reference to FIG. 1, referring to FIG. 2 and FIG. 3, the door 1 has an integrated operation center 6. The operation center 6 includes a user interface 61 and a handle groove 132 that is integrated in the operation center 6. When opening or closing the door 1, a hand of a user may reach into the handle groove 132.

The operation center 6 further includes a concave portion 133, and the hand of the user reaches into the handle groove 132 through the concave portion 133. The concave portion 133 is exposed to a front side and a right side of the door 1, so that the concave portion 133 may be accessible from the front side and the right side of the door 1.

The operation center 6 is arranged at a side, opposite to the other door 1', of the door 1. In this embodiment, the door 1' also includes a concave portion and a handle groove (which is not shown in the figure) that is accessible from the concave portion. Concave portions on the pair of doors 1 and 1' are oppositely arranged, and have a same length.

In this embodiment, the concave portion 133 and the handle groove 132 only extend at a partial length of the door 1. Therefore, the concave portion 133 and the handle groove 132 are at a distance from a top surface 102 and a bottom surface (which is not shown in the figure) of the door 1.

The user interface 61 is set to be used to receive input and/or output information of the user. The user interface 61 includes a user-interface electrical module 15. The user-interface electrical module 15 may include an output unit that is used to output information to a user (for example, setting information of the refrigerator 100 and/or information that is unrelated to a refrigerator such as a video or picture) and/or an input unit that is used to receive an instruction of the user. The user-interface electrical module 15 may include a display apparatus.

The user interface 6 includes multiple touch areas 14*a* indicated by touch identifications and a display area 14*b*.

The touch areas 14*a* and display area 14*b* are formed on a front panel 14 that is located in front of the user-interface electrical module 5.

The touch areas 14*a* may be separated from the display area 14*b* as shown in FIG. 2. In an alternative embodiment, the touch areas 14*a* are located in the display area 14*b*.

The user-interface electrical module 25 includes a light source. When the light source is turned on, light may penetrate through the display area 14*b*. Light may penetrate through the display area 14*b* when the light source is turned off. Then, in another embodiment, when the light source is turned off, light cannot penetrate the display area 14*b*. Under this condition, when the light source is turned off, the front panel 14 may be set in a manner that there may be no visual boundaries between the display area 14*b* and other parts of the front panel 14.

Viewed from a front side of the door 1, the front side of the door 1 has a boundary frame 63. The boundary frame 63 is connected to a side of the door 1. In this embodiment, the boundary frame 63 is connected to a right side surface 102 of the door 1, and opens to a right side of the door 1.

Viewed from the front side of the door 1, the operation center 6 is located in the boundary frame 63. That is, viewed from the front side, the user-interface electrical module 15, the user interface 61, the handle groove 132 and the concave portion 133 are located in the boundary frame 63, that is, the user interface 61, the handle groove 132 and the concave portion 133 do not go beyond the boundary frame 63 in horizontal and vertical directions of the door 1, that is, the user-interface electrical module 15, the handle groove 132 and the concave portion 133 are located at a rear side of the boundary frame 63.

The boundary frame 63 includes a pair of opposite first boundary lines 63*a* and a second boundary line 63*b* that is connected between the pair of first boundary lines 63*a*. The first boundary lines 63*a* extend from a right side surface 103 to a left side surface 102L for a predetermined distance. The first boundary lines 63*a* are parallel to each other.

In the vertical direction, the boundary frame 63 is at a distance from the top surface 103 and a bottom surface (which is not shown in the figure) of the door 1. Therefore, the operation center 6 is at a distance from the top surface 103 and the bottom surface of the door 1 in the vertical direction.

The concave portion 133, the handle groove 132 and the user interface 61 are arranged side by side in a depth direction of the handle groove 132 (which is also a horizontal direction of the door 1 in this embodiment). Visual elements of the user interface 61 that include the touch areas 14*a* and the display area 14*b*, the handle groove 132, and the concave portion 133 are arranged side by side in the horizontal direction of the door 1. The user-interface electrical module 15 that is located behind the front panel 14, the handle groove 132, and the concave portion 133 are also arranged side by side in the horizontal direction of the door 1.

In such way, the touch areas 14*a*, the display area 14*b* and the user-interface electrical module 15 lie alongside and do not overlap with the handle groove 132 and the concave portion 133 in a length direction of the handle groove 132 (which is also a length direction of the door 1 in this embodiment), but the touch areas 14*a*, the display area 14*b* and the user-interface electrical module 15 at least partly overlap in the depth direction of the handle groove 132 (which is also the horizontal direction of the door 1 in this embodiment). In this way, the handle groove 132 and the concave portion 133 may be constructed to have larger lengths inside the operation center 6 when needed.

In this embodiment, all touch areas 14*a* and the display area 14*b* are located between the handle groove 132 and the left side surface 102L of the door 1.

Figure 4:
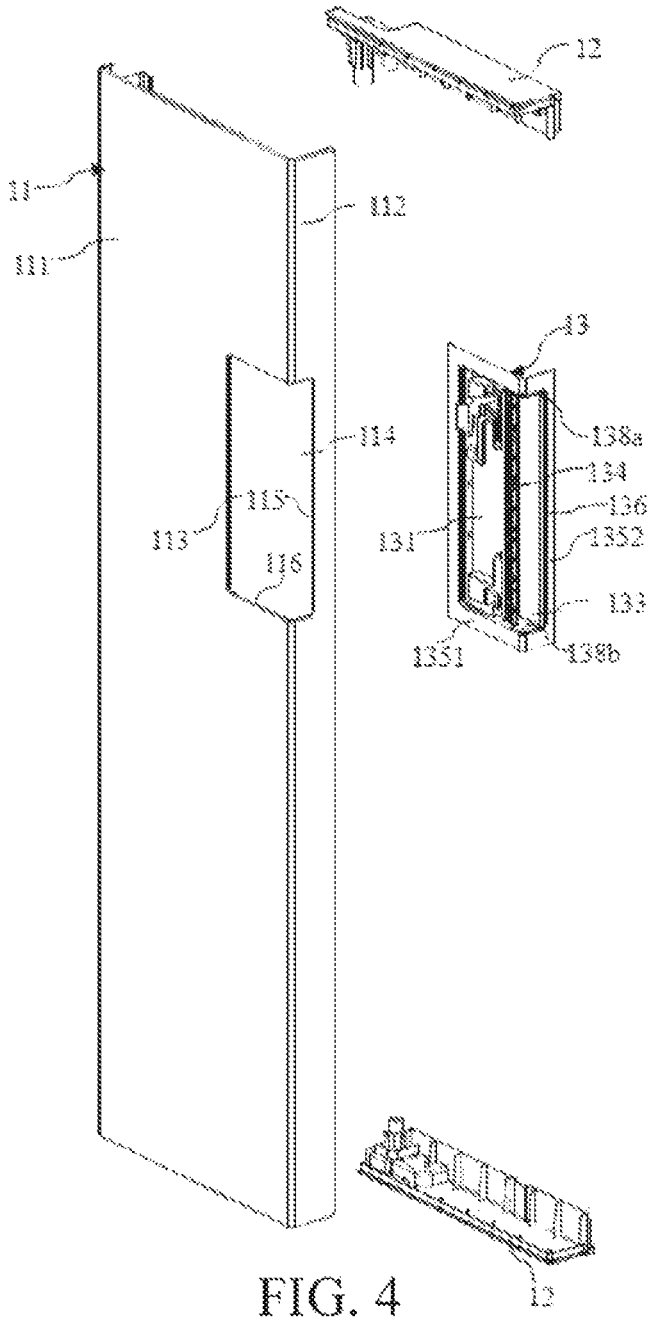
FIG. 4 is a schematic exploded view of a door main body shown in FIG. 3.
Figure 5:
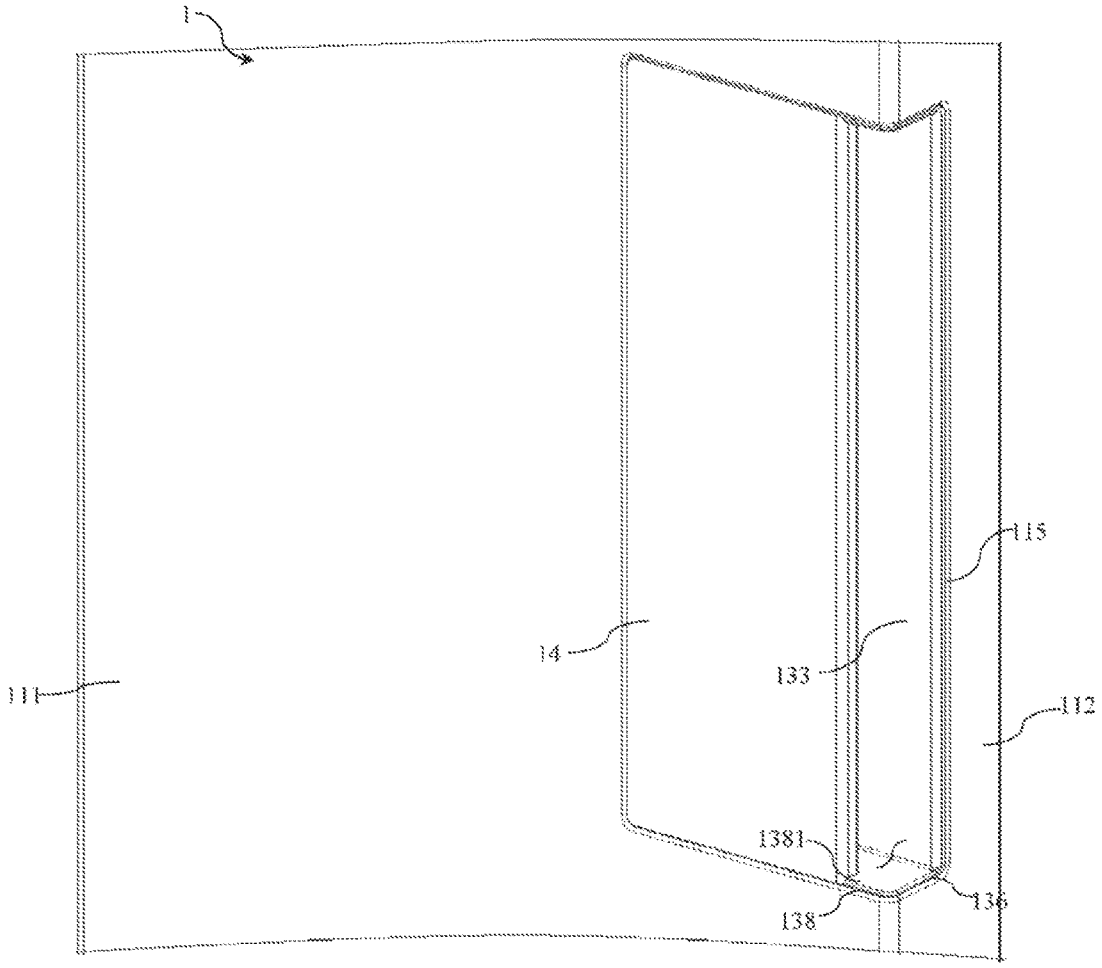
FIG. 5 is a locally enlarged view of FIG. 2.

Referring to FIG. 3 to FIG. 5, the door 1 includes a door main body 10. The user-interface electrical module 15 may be accommodated inside the door main body 10. The front panel 14 is detachably connected to the door main body 10 to cover the user-interface electrical module 15.

The user-interface electrical module 15 is connected to a rear surface of the front panel 14, so as to receive an instruction input by the user by touching the front panel 14.

Other than the user-interface electrical module 15, the handle groove 132 is also located behind the front panel 14. That is, in a front-to-rear direction, the handle groove 132 and the user-interface electrical module 15 are covered by a single panel, that is, the front panel 14.

A grip portion 134 is located between the handle groove 132 and the front panel 14 in a front-to-rear direction. The grip portion 134 forms a front boundary of the handle groove 132. When the hand of the user reaches into the handle groove 132, fingers of the user that reach into the handle groove 132 may grab the grip portion 134 to open the door 1. Generally, some fingers of the user press on a rear surface of the grip portion 134, another finger (for example, a thumb) presses on the front panel 14 that is located in front of the grip portion 134, and forces here to open a door 2.

The door main body 10 includes a door liner 16 (FIG. 5), a metal sheet 11, an upper/lower end cover 12, a user-interface housing 13, and a heat insulation layer 17 that is located in a thermal insulation space 171. The thermal insulation space 171 is defined together by the door liner 16, the metal sheet 11, the upper/lower end cover 12 and the user-interface housing 13. These components are non-detachably fixed together by the heat insulation layer 17 in a foaming process.

The metal sheet 11 includes a front wall 111. The front wall 111 is located in front of the door liner 16 and is at a predetermined distance from the door liner 16. In this embodiment, the front wall 111 is exposed to the front side of the door 1.

The metal sheet 11 includes a pair of side walls 112. Each side wall 112 is bent from a corresponding side of the front wall 111 and extends backwards. A rear end of the side wall 112 is connected to the door liner 16. The side walls 112 are at least approximately perpendicular to the front wall 111.

The front wall 111 has a first opening 113. The first opening 113 opens to a right end of the front wall 111. One of the side walls 112 has a second opening 114. The second opening 114 opens to a front end of the side wall 112. The first opening 113 and the second opening 114 are connected at a connection corner at which the front wall 111 and the side wall 112 are connected.

In the length direction of the door 1, the first opening 113 and the second opening 114 have a same height. In this embodiment, upper boundaries of the first opening 113 and the second opening 114 are located at a same height. Lower boundaries of the first opening 113 and the second opening 114 are also located at a same height.

In this embodiment, the first opening 113 and the second opening 114 are rectangular, and upper and lower boundaries of the first opening 113 and the second opening 114 are parallel to the top surface 103 of the door 1.

As an integral part of the door main body 10, the user-interface housing 13 is connected to the metal sheet 11 so as to seal the first opening 113 and the second opening 114 relative to the thermal insulation space 171 before the foaming process.

The user-interface housing 13 is approximately box-shaped so as to accommodate the user-interface electrical module 15, and the handle groove 132 and the concave portion 133 are disposed inside the user-interface housing 13.

The user-interface housing 13 includes at least a part of a receiving space 131 that is used for receiving the user-interface electrical module 15. The receiving space 131 opens towards the first opening 113.

The concave portion 133 is formed by a part of the user-interface housing 13 close to the side wall 112. The concave portion 133 opens towards the first opening 113 and the second opening 114. In this way, the concave portion 133 is dent backwards and inwards respectively from a front surface 101 and a right side surface 102 of the door. In this way, the user may have access to the handle groove 132 inside the user-interface housing 13 through the concave portion 133.

In conclusion, the receiving space 131, the handle groove 132 and the concave portion 133 are all located in the user-interface housing 13. The concave portion 133, the handle groove 132 and the receiving space 131 are sequentially arranged side by side in a depth direction of the handle groove 132. In the depth direction of the handle groove 132, the handle groove 132 is located between the receiving space 131 and the concave portion 133.

A length of the concave portion 133 is approximately equal to the length of the first opening 113 and the second opening 114. In this embodiment, the length of the concave portion 133 is slightly less than the length of the first opening 113 and the second opening 114, because a connection flange 115 is very close to the second opening 114, but is located outside the second opening 114 since there is an insertion groove 136 existing between the connection flange 115 and the second opening 114. In an alternative embodiment, when the connection flange 115 is located in the second opening 114, the length of the concave portion may also be equal to the length of the first and second opening 113 and 114.

A length of the handle groove 132 may be equal to a length of the concave portion 133, for example, the handle groove 132 and the concave portion 133 may have continuous end-boundary walls 138*a*, 138*b*.

Rear boundaries of the handle groove 132 and the concave portion 133 may be defined by a first rear wall 139*a* of the user-interface housing 13. A front surface of the first rear wall 139*a* may be continuous and smooth. A side, of the first rear wall 139*a*, that faces to the thermal insulation space 171 may be combined to the heat insulation layer 17.

In this embodiment, the front surface of the first rear wall 139*a* is parallel to the front wall 111. In this embodiment, the handle groove 132 and the concave portion 133 are formed by corresponding parts of an integral groove (not marked) within the user-interface housing 13.

The user-interface housing 13 has a separation wall 137 that separates the receiving space 131 and the handle groove 132. In this way, when the user opens the door, the hand of the user does not reach into the receiving space 131. The grip portion 134 is connected to a front end of the separation wall 137.

The grip portion 134 extends along a whole length of the handle groove 132. The grip portion 134 is located behind the front panel 14. The grip portion 134 may be substantially parallel to front panel 14. In this embodiment, the grip portion 134 is an integral part of the user-interface housing 13.

The front panel 14 is connected to user-interface housing 13 and located in the first opening 113. The front panel 14 covers the user-interface electrical module 15 and the grip portion 134. The front panel 14 may be made of plastics.

The front panel 14 includes at least the vast majority of a front plate portion 141 that covers the user-interface electrical module 15 and the grip portion 134 in a width direction of the door 1 (that is, a front-to-rear direction). The touch areas 14*a* and the display area 14*b* are distributed on the front plate portion 141. The front panel 14 further includes a side plate portion 142 bent from a side of the front plate portion 141 and extends backwards. In the depth direction of the handle groove 132, the side plate portion 142 covers at least a part of the grip portion 134. In this way, viewed from the side of the door 1, the door 1 may look simpler. The side plate portion 142 may be perpendicular to the front plate portion 141.

In a manufacturing process of the door 1, the user-interface housing 13, the upper/lower end cover 12 and the metal sheet 11 are installed together to form a door tray, and the door tray is sealed by the door liner 16 in the foaming process.

Figure 6:
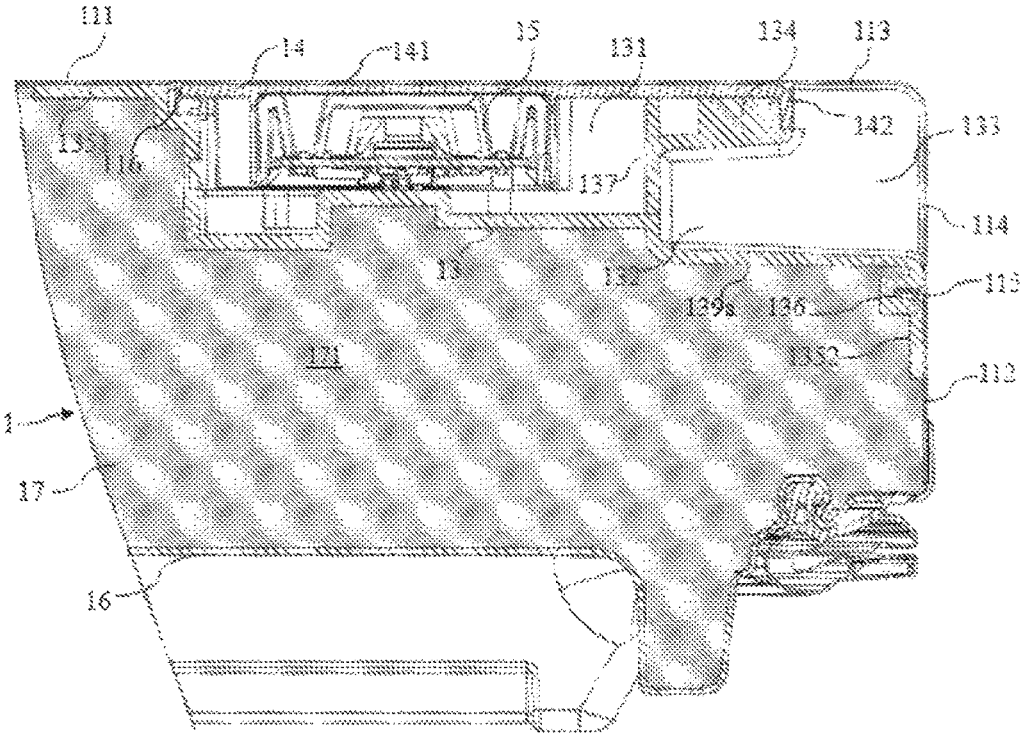
FIG. 6 is a schematic local sectional view along an A-A direction in FIG. 2.

Specifically, referring to FIG. 4 and FIG. 6, in this embodiment, the user-interface housing 13 has a first connection flange 1351 that is connected to a rear surface of the front wall 111, and a second connection flange 1352 that is connected to an inner surface of the side wall 112. The first connection flange 1351 is at least approximately perpendicular to the second connection flange 1352.

Shapes of the first connection flange 1351 and the second connection flange 1352 fit to the first opening 113 and the second opening 114 respectively, so that the first connection flange 1351 is attached to a rear side of the front wall 111 along the first opening 113, and the second connection flange 1352 is attached to an inner side of the side wall 112 along the second opening 114.

The metal sheet 11 includes a first flange 116 bent backwards from the front wall 111 and a second flange 115 bent inwards from the side wall 112, the first flange 116 and the second flange 115 are arranged along all edges of the first opening 113 and the second opening 114 respectively. The first flange 116 and the second flange 115 are connected, and are connected to the user-interface housing 13.

The user-interface housing 13 has a first insertion groove 138 that is arranged along a part of the first opening 113. Specifically, a pair of first insertion grooves 138 is in adjacent to a corresponding end of the concave portion 133.

The user-interface housing 13 includes a second insertion groove 136 that is arranged along the second opening 114. The first insertion groove 138 is connected to the second insertion groove 136. The first insertion groove 138 is substantially perpendicular to the second insertion groove 136.

The first flange 116 is inserted in the first insertion groove 138, and the second flange 115 is inserted in the second insertion groove 136. In this way, the user-interface housing 13 and the metal sheet 11 may be positioned in the foaming process.

In this embodiment, the first flange 116 includes a first part in adjacent to the concave portion 133 and a second part that is arranged along the front panel 14. When the first part of the first flange 116 is inserted in the first insertion groove 138, the second part of the first flange 116 is exposed in the receiving space 131. When the front panel 14 is connected to the user-interface housing 13 along the first opening 113, the second part of the first flange 116 is located between the user-interface housing 13 and the front panel 14 in a direction perpendicular to the first flange 116.

After the foaming process of the door 1, sides, of the user-interface housing 13, the upper/lower end cover 12, the metal sheet 11 and the door liner 12, that face to the thermal insulation space 171, are in contact with the heat insulation layer 17, and are non-detachably fixed to the heat insulation layer 17.

After the foaming process is completed, the user-interface electrical module 15 is put inside the receiving space 131. The front panel 14 is fixed to the door main body 10 so as to seal the receiving space 131 and cover the grip portion 134. The user-interface electrical module 15 may be pre-assembled on a rear portion of the front panel 14, and then the user-interface electrical module 15 and the front panel 14 are installed on the door main body 10 together.

The first insertion groove 138 has a groove wall 1381 in adjacent to the concave portion 133. In this embodiment, the groove wall 1381 is a part of a lower-end wall 138*b*. When the front panel 14 is connected to the door main body 10, a side of the front panel 14 close to the concave portion 133 is in contact with an end surface of the groove wall 1381 which end surface is to the front panel 14. In this way, a location of the front panel 14 can be defined.

The boundary frame 63 that surrounds the touch areas 14*a* and the display area 14*b* is defined by a boundary of the first opening 113. Specifically, a first boundary line 63*a* and a second boundary line 63*b* of the boundary frame 63 are formed by connection seams between the front wall 111 with the user-interface housing 13 or the front panel 14 at a boundary of the first opening 113. Therefore, viewed from the front of the door 1, the concave portion 133, the handle groove 132 and the user interface module 15 are located in the first opening 113 in horizontal and vertical directions of the door 1, that is, the concave portion 133, the handle groove 132 and the user-interface electrical module 15 (and the receiving space 131 for receiving the user-interface electrical module 15) do not go beyond the first opening 113 in the horizontal and vertical directions of the door 1.

A second preferred embodiment of the present invention is described with reference to FIG. 7 to FIG. 10.

Figure 7:
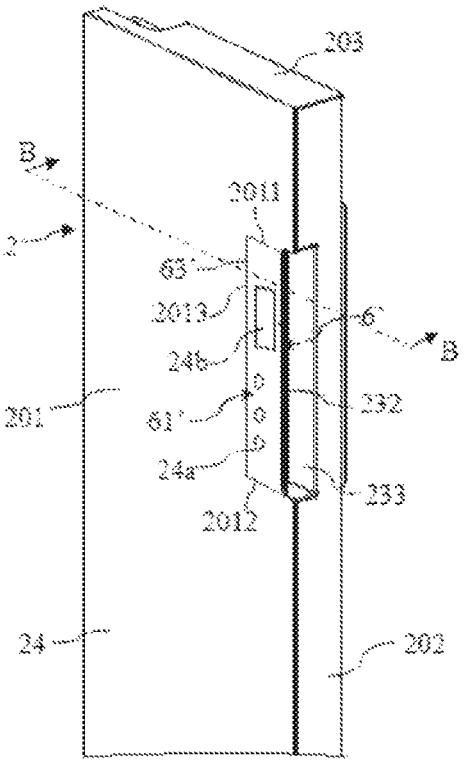
FIG. 7 is a schematic three-dimensional diagram of a part of a door according to another preferred embodiment of the present invention.

A shown in FIG. 7, similar to the first embodiment, a door 2 used in a refrigerator includes an operation center 6'. The operation center 6' includes a user interface 61', and a handle groove 232 and a concave portion 233 that are integrated in the user center 6'. The user interface 61', the handle groove 232 and the concave portion 233 are arranged side by side in a depth direction of the handle groove 232 (a horizontal direction of the door 1).

The operation center 6' includes multiple touch areas 24*a* and a display area 24*b*. The touch areas 24*a* may be located in the display area 24*b*. In an embodiment, the user interface 61' may be operated by touching any position of the display area 24*b*.

Figure 8:
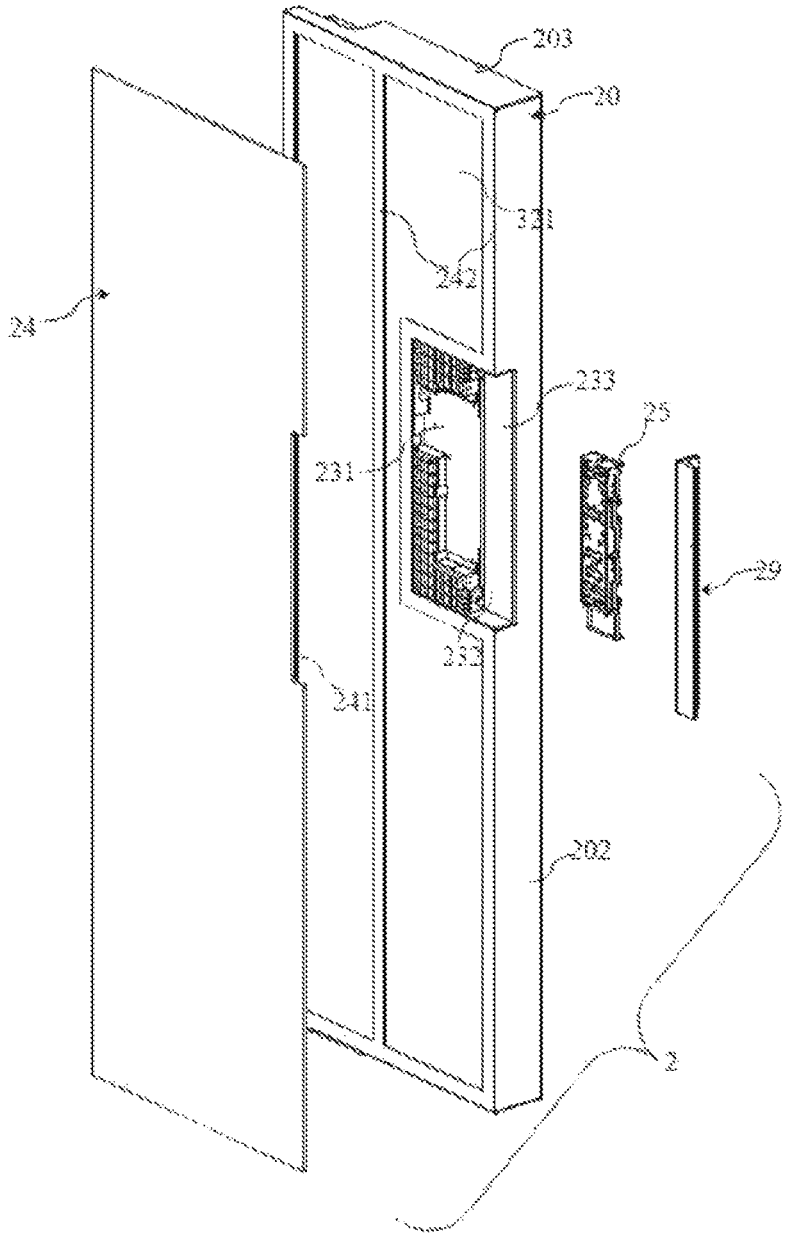
FIG. 8 is a schematic exploded view of a part of the door shown in FIG. 7.

With reference to FIG. 7, referring to FIG. 8, the door 2 includes a door main body 20 that has a heat insulation layer 27 and a front panel 24 that is connected to the door main body 20.

Different from the first embodiment, other than be arranged at the user interface 61', the front panel 24 also covers other parts of the door main body 20. The front panel 24 forms at least the vast majority of a front surface of the door 2. The touch areas 24*a* and the display area 24*b* are located on the front panel 24.

The front panel 24 may be made of glass, or made of a glass-like material. The front panel 24 may be adhered on the door main body 20 by using an adhesion apparatus 242. The adhesion apparatus 242 may be, for example, adhesive tape or glue.

At a rear side of the front panel 24, the door main body 20 has a receiving space 231 that is used to receive a user-interface electrical module 25. The user-interface electrical module 25 is connected to the rear side of the front panel 24, so as to receive an instruction input by a user by touching the front panel 24.

The receiving space 231 has an inlet open towards the handle groove 231. The inlet is sealed by a handle member 29 that is detachably connected to the door main body 20. After the front panel 24 is fixed to the door main body 20, and before the handle member 29 is not fixed to the door main body 20 or after the handle member 29 is disassembled from the door main body 20, the user-interface electrical module 25 may put in the receiving space 231 or take out the receiving space 231 through the concave portion 233 and the handle groove 232. The handle groove 232 is located between the concave portion 233 and the receiving space 231.

The front panel 24 has a boundary opening 241 at a side corresponding to the user interface 61'. The boundary opening 241 is located right in front of the concave portion 233, so as to expose the concave portion 233. The boundary opening 241 may have a shape that fits to the concave portion 233. In this way, the concave portion 233 is exposed to a front side of the door 2, and may be accessible from the front side of the door 2. In this embodiment, the concave portion 233 is also exposed to a right side of the door 2, and may be accessible from the right side of the door 2.

The handle member 29 is connected to the door main body 20 through the concave portion 233. The handle member 29 includes a grip portion 291. When a hand of the user reaches into the handle groove 232, fingers of the user may grab the grip portion 291. In a front-to-rear direction, the handle member 29 may be completely covered by the front panel 24, and the grip portion 291 is located between the handle groove 232 and the front panel 24. When the door opens, some fingers of the user press on a rear surface of the grip portion 291, another finger (for example, a thumb) may press on the front panel 24 that is located in front of the grip portion 291, and force here to open the door 2.

The front panel 24 has a printed instruction frame 63' (only shown in FIG. 7). The instruction frame 63' includes a pair of first boundary lines 2011, 2012. A first end of each of the first boundary lines 2011, 2012 is connected to an upper edge or a lower edge of the boundary opening 241, and extends towards a left side of the front panel 24 for a predetermined length. The instruction frame 63' includes a second boundary line 2013 that is connected to the pair of first boundary lines 2011, 2012. The second boundary line 2013 is connected to a second end of the first boundary lines 2011, 2012 (that is, an end away from the boundary opening 241), so as to be separated from the boundary opening 241.

Visual elements (including the touch areas 24*a* and the display area 24*b*) of the user interface 61' are located in the instruction frame 63' in horizontal and vertical directions of the door 2.

The instruction frame 63' and the upper edge and the lower edge of the boundary opening 241 together form a boundary frame. The boundary frame is connected to a right side surface 202 of the door 2, and opens at the right side surface 202 of the door 2. That is, the boundary frame is not of a closed loop, but opens at the right side surface 202 of the door 2. In horizontal and vertical directions of the door 2, the user interface 61', the handle groove 232 and the concave portion 233 are located in the boundary frame, that is, the user interface 61', the handle groove 232 and the concave portion 233 do not go beyond the boundary frame in horizontal and vertical directions of the door 2. In a front-to-rear direction, a part of the user interface 61', the handle groove 232 and the concave portion 233 are located behind the boundary frame on the door 2.

Figure 10:
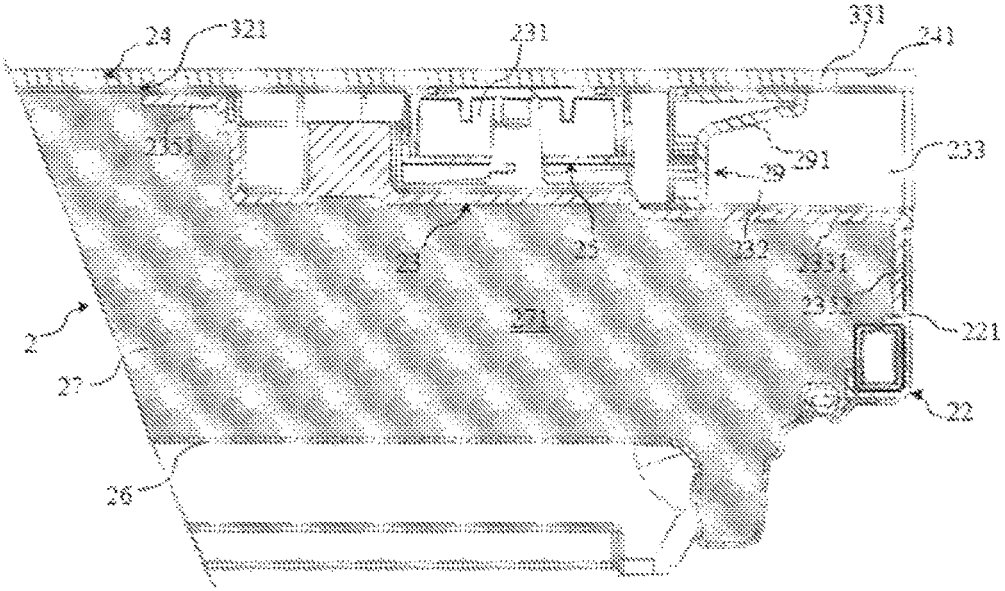
FIG. 10 is a local sectional view along a B-B direction in FIG. 7.
Figure 9:
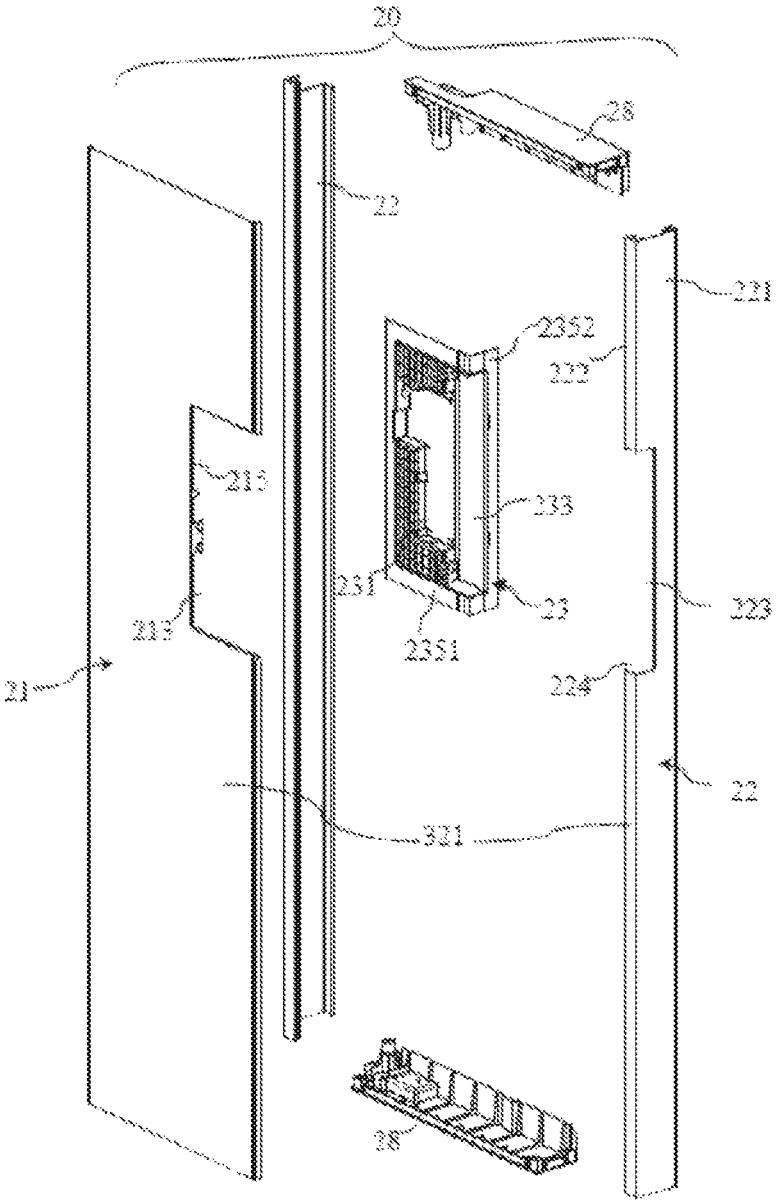
FIG. 9 is a schematic exploded view of a door main body shown in FIG. 8.

Referring to FIG. 8, FIG. 9 and FIG. 10, the door main body 20 includes a metal sheet 21, a pair of door jambs 22 that are connected to corresponding vertical sides of the metal sheet 21, upper-end and lower-end handle members 28 that are connected to an upper end and a lower end of the metal sheet 21 respectively, and a user-interface housing 23 that is connected to the metal sheet 21 and a corresponding door jamb 22. The heat insulation layer 27 is filled in the thermal insulation space 271 that is surrounded by the metal sheet 21, the door jambs 22, the end handle members 28, the user-interface housing 23 and the door liner 26. The metal sheet 21, the door jambs 22, the end handle members 28, the user-interface housing 23 and the door liner 26 are non-detachably fixed together by the using the heat insulation layer 27.

In this embodiment, each door jamb 22 has a side wall 221 that forms a main part of the door jamb 22, and a front strip 222 that is connected at a front end of the side wall 221 and extends inwards.

The metal sheet 21 is connected to the door jambs 22, so that the front strip 222 and the metal sheet 21 together form a front wall 321 of the door main body 20 and located in front of the liner 26. Each front strip 222 is located at a corresponding side of the metal sheet 21.

The front wall 321 has a first opening 331 (shown in FIG. 10). The first opening 331 is formed together by a first opening portion 213 on the metal sheet 21 and a second opening portion 224 that is located on a right door jamb 22.

The side wall 221 has a second opening 223. The first opening 331 is in communication with the second opening 223 at a connection corner of the front wall 321 and the side wall 221.

The user-interface housing 23 is connected to the front wall 321 and the side wall 221 so as to seal the first opening 331 and the second opening 223 relative to the thermal insulation space 271, that is, the thermal insulation space 271 at the first opening 331 and the second opening 223 may be sealed because of the user-interface housing 23.

Similar to the first embodiment, the user-interface housing 23 is approximately box-shaped so as to accommodate the user-interface electrical module 25, and the handle groove 232 and the concave portion 233 are located in the user-interface housing 23.

Similar to the first embodiment, the user-interface housing 23 has a first connection flange 2351 that is connected to a rear surface of the front wall 321, and a second connection flange 2352 that is connected to an inner surface of the side wall 221. The metal sheet 21 may have a connection flange 215 that is arranged along the first opening portion 211 and is in insertion connection to the user-interface housing 23.

The user-interface housing 23 includes at least a part of a receiving space 231 that is used for receiving the user-interface electrical module 25. The receiving space 231 opens towards the first opening 331. In this way, the user-interface electrical module 25 may be in contact with the front panel 24.

The concave portion 233 is formed by a part of the user-interface housing 23 close to the side wall 221. The concave portion 233 opens towards the first opening 331 and second opening 223, to be exposed to a front surface 201 and a right side surface 202 of the door. In this way, the user may have access to the handle groove 232 inside the user-interface housing 23 through the concave portion 233.

As shown in FIG. 10, depths of the handle groove 232, the concave portion 233 and the receiving space 231 may be different at a width direction of the door 2. Rear boundaries of the handle groove 232 and the concave portion 233 may be defined by a continuous and smooth rear wall 2331. The rear wall 2331 is an integral part of the user-interface housing 23, and is combined with the heat insulation layer 27.

A length of the concave portion 233 may be equal to or slightly less than a length of the first opening 331. In an embodiment, by arranging properly a relationship between the front wall 321 and the user-interface housing 23, for example, the front wall 321 has an end boundary that reaches into the user-interface housing 23 and forms a concave portion, and the length of the concave portion 233 may be accurately equal to the length of the first opening 331; or, in an alternative embodiment, the length of the concave portion is slightly less than the length of the first opening, for example, a wall of the user-interface housing 23 that is used to form an end boundary of the concave portion is located in the first opening 331 and close to an edge of the first opening 331.

In conclusion, the receiving space 231, the handle groove 232 and the concave portion 233 are all located in the user-interface housing 23. The concave portion 233, the handle groove 232 and the receiving space 231 are sequentially arranged side by side in a depth direction of the handle groove 232. In the depth direction of the handle groove 232, the handle groove 232 is located between the receiving space 231 and the concave portion 233.

Embodiments of single components and parts described with reference to FIG. 1 to FIG. 10 may be combined in any given manner, to achieve advantages of the present invention. In addition, the present invention is not limited to the described embodiments. Generally, in addition to the described means, other means may also be used, as long as these means can also achieve a same effect.

What is claimed is:

1. A refrigerator, comprising a door, said door including:

a user-interface electrical module;

a door liner;

a front wall being disposed in front of said door liner and having a first opening;

a side wall having a second opening being in communication with said first opening;

a thermal insulation space disposed between said door liner and said front wall;

a heat insulation layer filling said thermal insulation space;

a user-interface housing closing said first opening and said second opening relative to said thermal insulation space; and a handle groove disposed within said user-interface housing;

said user-interface housing having a receiving space for receiving said user-interface electrical module, and said user-interface housing having a concave portion being open towards said first opening and said second opening to provide access to said handle groove, said user-interface housing including a rear wall being fixedly attached to said heat insulation layer, and said rear wall defining rear boundaries of said handle groove and said concave portion.

2. The refrigerator according to claim 1, wherein said concave portion has a length being equal to or less than a length of at least one of said first opening or said second opening.

3. The refrigerator according to claim 1, wherein said door has a top surface and a pair of opposite edges bordering said first opening and being parallel to said top surface.

4. The refrigerator according to claim 1, wherein said first opening and said second opening are located at an identical height along said door and have an identical length in a length direction of said side wall.

5. The refrigerator according to claim 1, wherein said concave portion, said handle groove and said user-interface electrical module are sequentially disposed side by side in a depth direction of said handle groove.

6. The refrigerator according to claim 1, which further comprises:

a handle member being detachably connected to said user-interface housing;

said receiving space having an inlet being open towards said handle groove;

said user-interface electrical module being accessible through said inlet; and said inlet being closed by said handle member.

7. The refrigerator according to claim 1, wherein said door includes a grip portion disposed in front of said handle groove and said door includes a one-piece front panel, said front panel covering said user-interface electrical module and said grip portion in a front-to-rear direction.

8. The refrigerator according to claim 7, wherein said grip portion is an integral part of said user-interface housing.

9. The refrigerator according to claim 7, wherein said front panel covers said front wall, and said front panel has one edge with an edge opening corresponding to said concave portion.

10. The refrigerator according to claim 7, wherein said front panel is detachably fixed to said user-interface housing along said first opening.

11. The refrigerator according to claim 10, wherein:

said first opening defines an edge;

said front wall has a first flange being bent backwards from said edge of said first opening;

said user-interface housing has a first insertion groove adjacent a corresponding end of said concave portion;

said first flange has a first part overlapping said concave portion in a length direction of said concave portion, and said first flange has a second part surrounding an edge of said front panel; and said first part is inserted into said first insertion groove and said second part is disposed between said front panel and said user-interface housing.

12. The refrigerator according to claim 11, wherein said user-interface housing includes a groove wall of said first insertion groove facing towards said concave portion, and said front panel is in contact with an end surface of said groove wall facing towards said front panel.

13. The refrigerator according to claim 7, wherein said front panel includes a front plate portion covering said user-interface electrical module and said grip portion in a front-to-rear direction, said front panel includes a side plate portion being connected to one side of said front plate portion and extending backwards, and said side plate portion covers at least a part of said grip portion in a depth direction of said handle groove.

14. The refrigerator according to claim 1, wherein said user-interface housing includes a first connection flange being connected to a rear surface of said front wall, said user-interface housing includes a second connection flange being connected to said side wall, and said first connection flange is at least approximately perpendicular to said second connection flange.

* * * * *